US012545373B2

(12) United States Patent
Falzon

(10) Patent No.: US 12,545,373 B2
(45) Date of Patent: Feb. 10, 2026

(54) INFLATABLE KAYAK

(71) Applicant: JLF Online LLC, Walled Lake, MI (US)

(72) Inventor: Janice Falzon, Walled Lake, MI (US)

(73) Assignee: JLF Online LLC, Walled Lake, MI (US)

( * ) Notice: Subject to any disclaimer, the term of this patent is extended or adjusted under 35 U.S.C. 154(b) by 700 days.

(21) Appl. No.: 17/967,473

(22) Filed: Oct. 17, 2022

(65) Prior Publication Data

US 2023/0119763 A1 Apr. 20, 2023

Related U.S. Application Data

(60) Provisional application No. 63/257,234, filed on Oct. 19, 2021.

(51) Int. Cl.

| | |
|---|---|
| ***B63B 34/22*** | (2020.01) |
| ***B63B 5/24*** | (2006.01) |
| ***B63B 13/00*** | (2006.01) |

(52) U.S. Cl.

CPC ..... *B63B 34/22* (2020.02); *B63B 5/24* (2013.01); *B63B 13/00* (2013.01)

(58) Field of Classification Search

CPC ..... B63B 34/00; B63B 34/20; B63B 34/21; B63B 34/22; B63B 13/00; B63B 5/24

USPC ..... 114/343, 345, 347

See application file for complete search history.

(56) References Cited

U.S. PATENT DOCUMENTS

| | | | | |
|---|---|---|---|---|
| 8,286,573 | B2 | 10/2012 | Hoge | |
| 8,800,466 | B1 * | 8/2014 | Shimozono | B63B 39/10 114/345 |
| 8,821,204 | B1 | 9/2014 | Hoge | |
| 9,452,809 | B2 | 9/2016 | Hoge | |
| 9,637,201 | B2 | 5/2017 | Hoge | |
| 10,479,449 | B2 | 11/2019 | Cooper | |
| 10,913,518 | B2 * | 2/2021 | Prade | B63B 73/46 |
| 11,124,276 | B2 | 9/2021 | Ding | |
| 11,401,008 | B2 | 8/2022 | Cooper | |
| 2019/0023353 | A1 | 1/2019 | Hoge | |
| 2020/0239113 | A1 * | 7/2020 | Prade | B63B 32/53 |
| 2021/0001955 | A1 * | 1/2021 | Cooper | B63B 25/00 |

* cited by examiner

*Primary Examiner* — Daniel V Venne
(74) *Attorney, Agent, or Firm* — Brooks Kushman P.C.

(57) ABSTRACT

An inflatable kayak is provided with a floor formed of a first drop-stitch inflatable chamber. A port side is formed of a second drop-stitch inflatable chamber and a starboard side formed of a third drop-stitch inflatable chamber. A flexible fabric hull panel covers an outboard bottom of the floor, and at least a portion of an outboard surface of the port and starboard side. A hull portion is flexible and may be attached to the flexible fabric hull at a forward portion to form a bow contour with a sloping ridge. The front hull portion does not extend below a bottom surface defined by the floor. A rigid skeg attached to the flexible fabric hull at a rear portion and configured to be removable.

20 Claims, 4 Drawing Sheets

INFLATABLE KAYAK

CROSS-REFERENCE TO RELATED APPLICATIONS

This application claims the benefit of U.S. provisional application Ser. No. 63/257,234 filed Oct. 19, 2021, the disclosure of which is hereby incorporated in its entirety by reference herein.

TECHNICAL FIELD

The present application relates to an inflatable watercraft, in particular an inflatable kayak.

BACKGROUND

Canoers use single-bladed paddles and either kneel on the boat or sit on an elevated seat. Kayakers use double-bladed paddles and sit in a low seat with their legs stretched forward. A stand up paddle board (SUP) involves standing on a board and using a longer, single-bladed paddle to move. The biggest challenge in using a SUP is usually balancing on the board, which takes some coordination and core strength.

SUMMARY

According to one embodiment, an inflatable kayak is provided having an inflatable floor and inflatable sides each formed of pressure drop-stitch material. The inflatable kayak has a flexible bow portion attached to at least one of the inflatable floor and drop-stitch inflatable sides.

According to at least one embodiment, an inflatable kayak is provided with a floor formed of a first drop-stitch inflatable chamber. A port side is formed of a second drop-stitch inflatable chamber and a starboard side formed of a third drop-stitch inflatable chamber. A flexible fabric hull panel covers an outboard bottom of the floor, and at least a portion of an outboard surface of the port and starboard side. At least one flexible hull portion is attached to the fabric hull panel and forms a bow contour and/or a stern contour extending from the fabric hull.

In another embodiment, the flexible hull portion defines a front hull portion and is attached to the flexible fabric hull at a forward portion to form the bow contour with a sloping ridge. The front hull portion does not extend below a bottom surface defined by the floor.

In another embodiment, a rigid skeg is attached to the flexible fabric hull at a rear portion and is configured to be removable.

In another embodiment, an air chamber is formed between the fabric hull panel and the front hull portion when the kayak is inflated.

In another embodiment, the hull portion has a notched opening to naturally allow airflow to the air chamber as the kayak is inflated and deflated.

In another embodiment, the flexible hull portion is attached to the fabric panel along a forward portion to form the bow contour.

In another embodiment, the floor, the port side and the starboard side are attached to the fabric hull panel at spaced apart locations when deflated.

In another embodiment, the port and starboard side abut lateral sides of the floor when inflated.

In another embodiment, the port and starboard sides are configured to extend generally perpendicular to an upper surface of the floor.

In another embodiment, the flexible hull portion is positioned adjacent at least one of a distal bow end or a distal stern end, wherein the floor does not extend to the distal bow end or distal stern end.

In another embodiment, the flexible hull portion is formed of flexible PVC fabric.

In another embodiment, the flexible PVC fabric is glued or welded to the fabric hull panel.

In another embodiment, the kayak has a pair of footrest pedals. One footrest pedal is attached to each of the port and starboard sides.

In another embodiment, each of the footrest pedals has a mount attached on the port and starboard sides. A footrest bar is slidable relative to the mount to allow the footrest pedals to be adjusted.

In another embodiment, the kayak has at least one self-bailing drain having an opening extending through the floor. There are no drop-stitch fibers in the opening of the self-bailing drain.

In another embodiment, the kayak has at least one seat mounted within the kayak and attached to at least one of the floor and port and starboard sides.

In another embodiment, the floor, the port side and the starboard side are glued or welded to the fabric panel.

According to at least one embodiment, an inflatable kayak is provided with a floor formed of a first drop-stitch inflatable chamber. A port side is formed of a second drop-stitch inflatable chamber and a starboard side formed of a third a drop-stitch inflatable chamber. A flexible fabric hull panel covers an outboard bottom of the floor, and at least a portion of an outboard surface of the port and starboard side. A front hull portion is flexible and attached to the flexible fabric hull at a forward portion and forms a bow contour with a sloping ridge. The front hull portion does not extend below a bottom surface defined by the floor. A rigid skeg is attached to the flexible fabric hull at a rear portion and is configured to be removable.

According to at least one embodiment, an inflatable kayak is provided with a floor formed of a first drop-stitch inflatable chamber. A port side is formed of a second drop-stitch inflatable chamber and a starboard side formed of a third a drop-stitch inflatable chamber. A flexible fabric hull panel connects the floor, the port side and the starboard side. There is no rigid hull portion to allow the kayak to be folded to a compact storage position. A rigid skeg is attached to a rear portion and configured to be removable when the kayak is folded to the compact storage position.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Hard molded rigid kayaks having a "sit-inside" style have an open cockpit where the paddler climbs in and actually sits inside the hull of the kayak with his legs under the deck. If you flip your kayak over, it is difficult to get back inside and you will have to swim your kayak to shore to get back in. Inflatable kayaks provide ease of storage and transport, as well as the ability to be deflated for extended portage.

The inflatable kayak 10 incorporates drop-stitch technology. Prior inflatable kayaks used tube shaped designs. However, the typical tube shape design and construction is slow on the water and not very durable. The drop stitch technology has a drop-stitch core of thousands of fine threads, that is then covered by one or more layers of PVC. The drop-stitch construction is extremely durable and allows for all types of paddling activities, and when deflated, can be small enough to fit into a backpack.

As shown in FIGS. 1-4, an inflatable kayak 10 is shown according to various embodiments. Unlike a typical sit inside kayak, with the inflatable kayak 10, you can re-enter your kayak from the water. The inflatable kayak 10 can also be used for stand-up paddle boarding and sit inside kayaking. The inflatable kayak 10 may have various lengths. For example, the kayak 10 may be a single person kayak with a length from 9-12 feet. A tandem kayak for two people may be up to 15 feet or longer. The kayak 10 may have a width of 28-34 inches, and a depth of 9-12 inches. However, other dimensions are possible.

Figure 5:
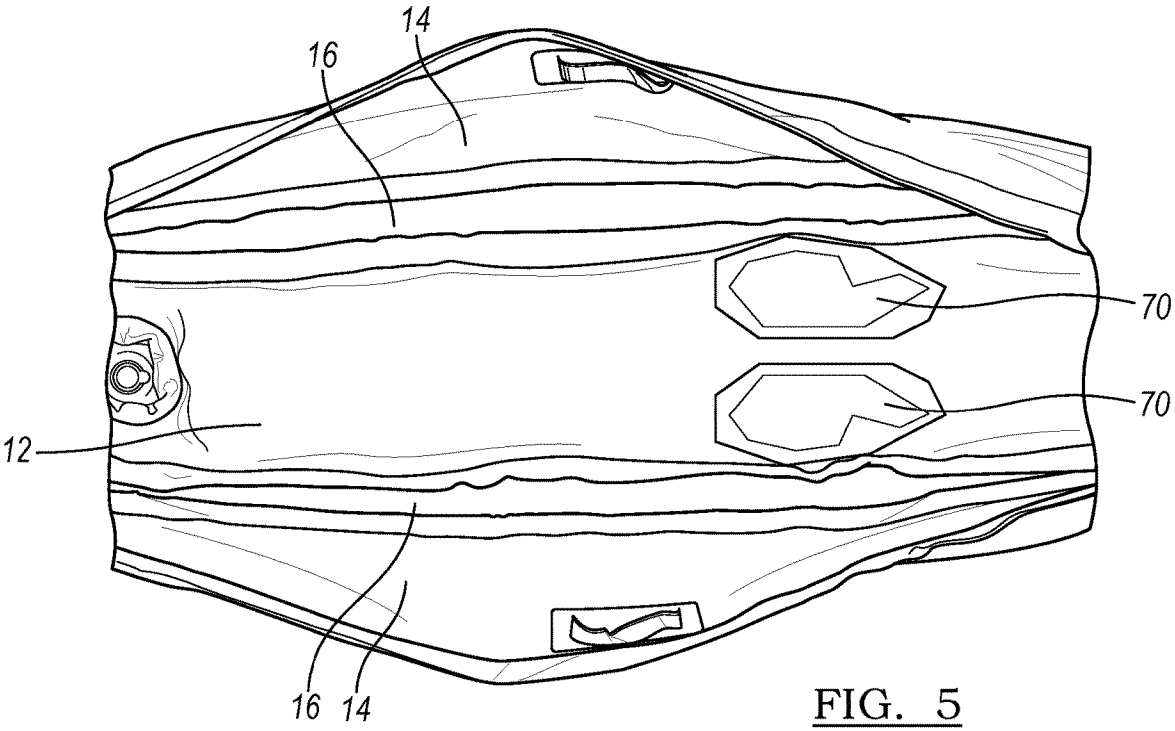
FIG. 5 is a top view of a portion of the inflatable kayak in FIG. 1 in a deflated state.

FIG. 5 shows the kayak in a deflated state so that the arrangement of the inflatable components can be more easily seen. The inflatable kayak 10 is formed of an inflatable floor 12 and port and starboard inflatable sides 14. The floor 12 and sides 14 are formed of high pressure drop-stitch material. A fabric layer 16 forms the outer surface of the kayak 10. The fabric layer 16 is not inflatable and may be formed of polyvinyl chloride (PVC), or other suitable fabric.

The inflatable floor 12 is tapered at both the fore and aft ends. The inflatable floor 12 may not extend all the way to the bow, as show in broken lines in FIGS. 3-4. The inflatable sides 14 are also tapered at the fore and aft ends, and angle toward the bow caps 20 and stern caps 22. The bow cap 20 defines the distal bow end of the kayak, and the stern cap 22 defines the distal stern end of the kayak 10. The fabric layer 16 extends along the bottom of the floor 12 and bottom of the sides 14. The fabric layer 16 does not cover the entire outer wall of the inflatable sides 14.

As shown in FIG. 5, the inflatable sides 14 and inflatable floor 12 are attached to the fabric layer 16. The inflatable sides 14 are glued or welded to the fabric floor. The inflatable sides 14 are not glued or welded directly to the outside edges of the inflatable floor 12. Once inflated, the sides 14 abut the floor 12 and may be generally perpendicular. Once inflated, the kayak 10 has an open cockpit that is easy for a user to get into and without any additional inflatable chambers. A skirt panel 60 may extend between the sides 14 adjacent the bow cap 20 and stern cap 22. The skirt panel 60 may be formed of PVC, or other suitable material.

The inflatable floor 12 and inflatable sides 14 are not configured to be inflated to at least 15 psi. The floor 12 and sides 14 are configured to be inflated to 5-8 psi with a valve limitation maximum of 15 psi.

Figure 1:
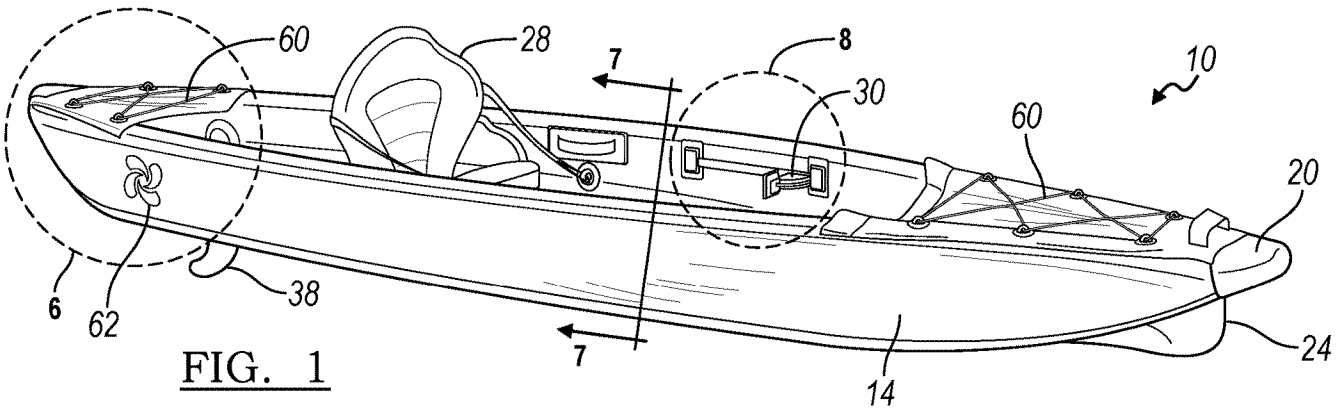
FIG. 1 is a perspective view of an inflatable kayak of the present application according to one example.
Figure 3:
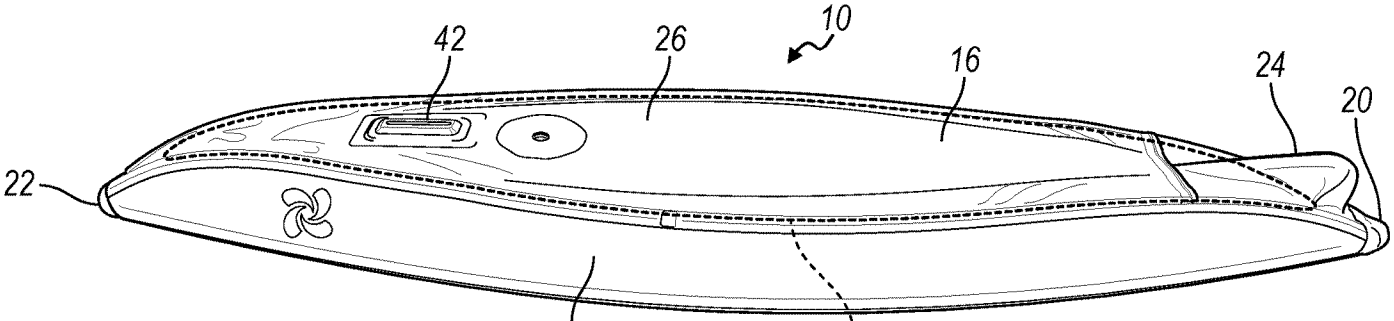
FIG. 3 is a bottom perspective view of the inflatable kayak in FIG. 1
Figure 11:
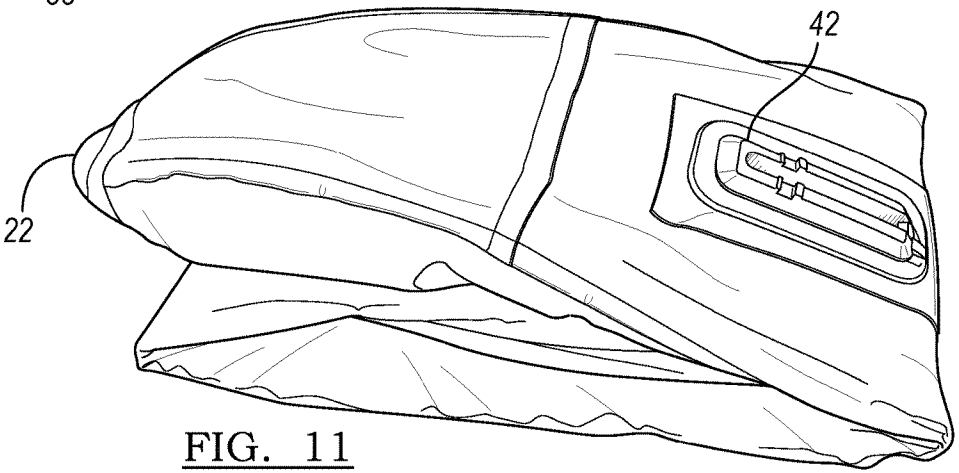
FIG. 11 illustrates the inflatable kayak deflated and fully folded to a storage position.

As shown in FIG. 1, a flexible bow cap 20 is attached at the bow portion. The flexible bow cap 20 is attached to the inflatable floor 12 and inflatable sides 14. The bow cap 20 may be attached by gluing or any suitable method. Similarly, at the stern of the inflatable kayak is a flexible stern cap 22. The flexible stern cap 22 is also attached to the inflatable floor and inflatable sides, for example by gluing. The kayak 10 also has a front hull portion 24 positioned adjacent the bow cap 20. The front hull portion 24 is flexible to allow the kayak 10 to be easily folded to a compact storage position. A removeable skeg 38 is attached on the aft-portion of the bottom of the inflatable kayak 10. The skeg 38 may be removably attached to the kayak 10 via a fin box 42, as shown in FIG. 3 and FIG. 11. The skeg 38 may be rigid and formed of molded plastic, or composite, for example. The skeg 38 extends below the bottom surface of the kayak 10 and may have a length of 6-15 inches. In another embodiment, the kayak 10 may include a rear hull portion adjacent the stern cap 22, similar to the front hull portion 24. The inflatable kayak 10 may have a symmetrical shape in a fore and aft direction.

Figure 6:
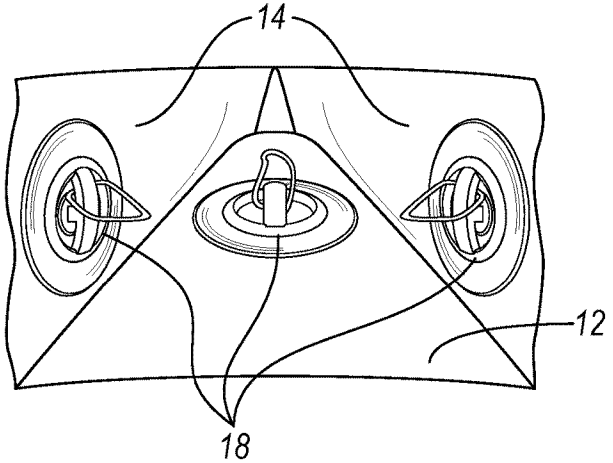
FIG. 6 is a detailed view of a portion of the inflatable kayak shown in FIG. 1.

FIG. 6 shows a detailed view of a portion of the inflatable kayak shown in FIG. 1. Each of the inflatable floor 12 and sides 14 is inflatable separately through inflation ports or inflation valves 18. There is no drop-stitch core 50 at the location of the valves 18. Opposite the valve opening 18, the sides 14 may include a logo 62 to conceal any distortion or bulging caused by the lack of drop-stitch fibers. The valves 18 may be located adjacent each other to allow for quickly filling each of the sides 14 and floor 12. However, the valves 18 may be located at any suitable position on the kayak 10.

Figure 7:
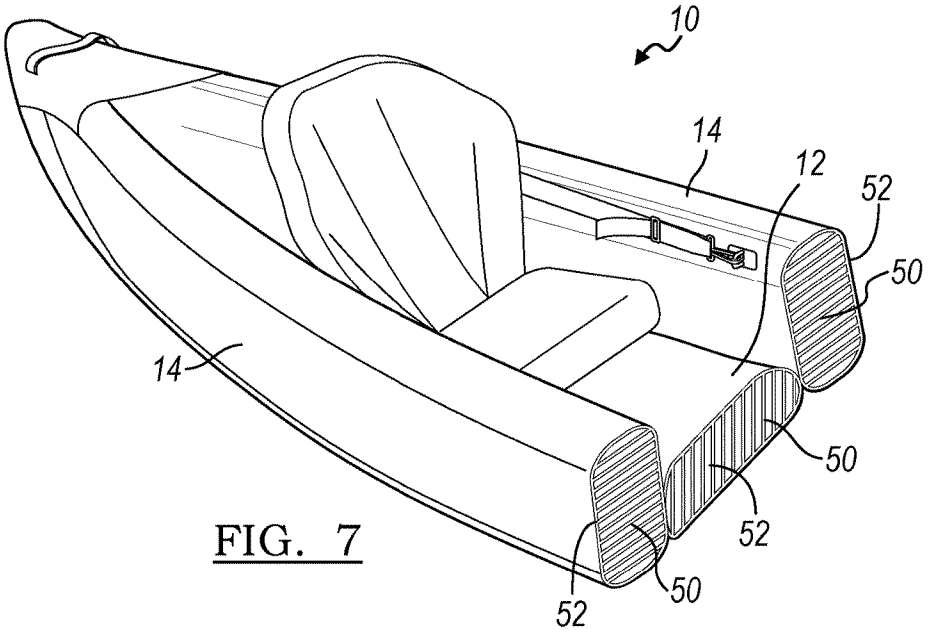
FIG. 7 is a perspective section view of an example inflatable kayak like that shown in FIG. 1.

FIG. 7 illustrates a perspective section view of an example inflatable kayak 10 with inflatable floor 12 and inflatable sides 14 formed with a drop-stitch core 50 and having a flexible outer surface 52 formed of a suitable flexible material such as polyvinyl chloride (PVC). The drop-stitch construction allows the kayak to be inflated while maintaining stable surfaces that are not bulbous and instead are generally flat or planar. For example, the inflatable floor 12 provides a flat, planar surface that a user can stand on and is not easily compressed when inflated. As shown in FIG. 7, the inflatable sides 14 are generally perpendicular to the inflatable floor 12 when the kayak is inflated.

Figure 9:
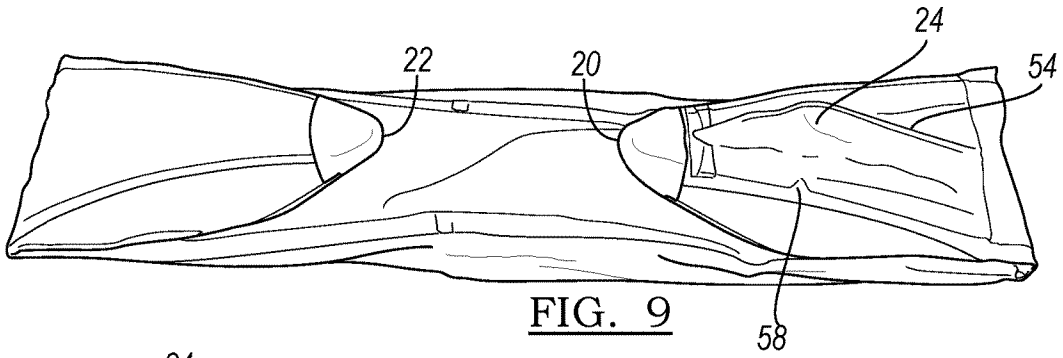
FIG. 9 illustrates the inflatable kayak of FIG. 1 being deflated and folded.

FIG. 9 illustrates the kayak deflated and partially folded. In FIG. 9, the front hull portion 24 is shown folded and the rear portion is folded.

Figure 10:
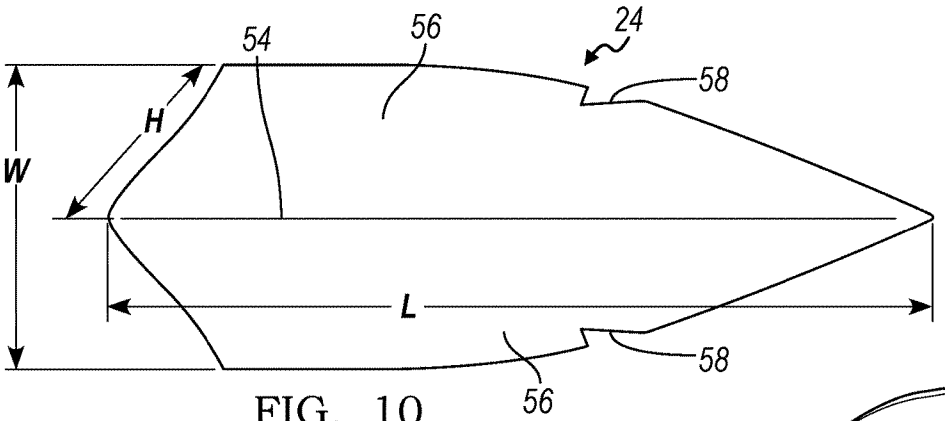
FIG. 10 is a detailed view of the front hull portion removed from the kayak.

The front hull portion 24 is shown in more detail in FIG. 10. The front hull portion 24 provides water separation, which is beneficial to reduce resistance and facilitate navigation. The front hull portion 24 is formed of PVC and is flexible to allow the kayak to be folded easier. The hull portion 24 has a central ridge 54 and side panels 56 that slope away from the ridge 54. The hull portion 24 has at least one notch 58 that allows the front hull portion 24 to fill with air naturally as the kayak is unfolded and inflated. Once the kayak 10 is inflated and expands, air enters front hull portion 24 through the notches 58 to maintain the contour and shape of the hull portion 24 at the fore of the kayak.

Figure 2:
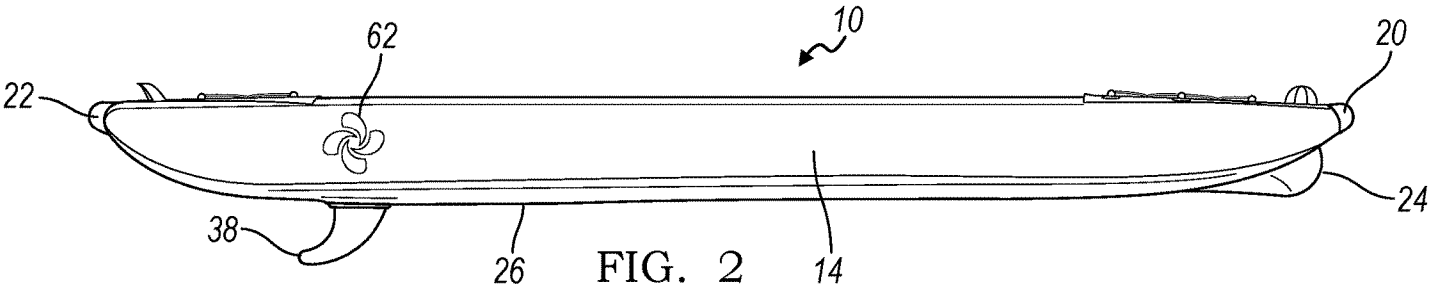
FIG. 2 is a side view of the inflatable kayak in FIG. 1.

The flexible hull portion 24 is attached to the fabric layer 16 along its edges and may be glued or welded to the fabric layer 16. The material of the fabric layer 16 may have a thickness of 5-9 mm, for example. The flexible hull portion 24 may be thicker than the floor material in order to better maintain the hull contour while in use. As shown in FIG. 2, the front hull portion 24 may not extend below the bottom surface 26 of the kayak. The hull portion 24 may have a maximum overall height H of approximately 5-8 inches, an overall length L of approximately 19-23 inches, and an overall width of approximately W of approximately 15-20 inches. However, the size of the hull portion 24 may vary based on the size and dimensions of the kayak.

As shown in FIG. 11, the kayak 10 may be fully folded to a storage position. In the storage position, the front hull portion 24 may be folded and compressed to allow the kayak 10 to be compactly stored.

Figure 4:
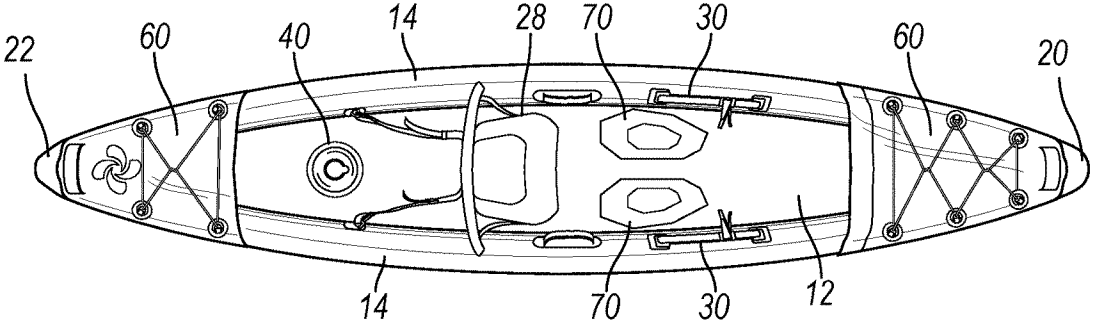
FIG. 4 is a top view of the inflatable kayak in FIG. 1.
Figure 8:
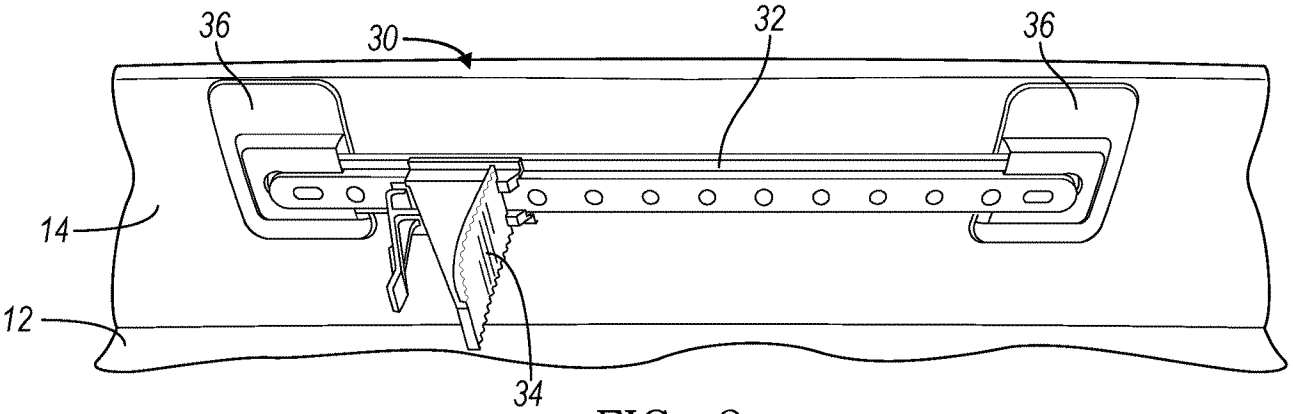
FIG. 8 is a detailed view of an adjustable pedal of the inflatable kayak.

FIG. 8 illustrates the adjustable rigid footrests 30 in more detail. The adjustable rigid footrests 30 are secured to the inflatable sides 14. The footrests 30 have mounts 36 that may be glued or welded to the inflatable sides. Since the inflatable sides 14 have generally flat and planar walls, the mounts 36 can be securely attached with a wide mounting surface. As shown in FIG. 8, the footrest 30 has a bar 32 with the pedals 34. The bar 32 has a rectangular cross-section that slides within a mating feature on the mounts 36. The rectangular cross-section of the bar 32 ensures the foot pedals 34 do not rotate and remain in position. The bar 32 and pedals 34 may be adjusted to the user's feet while seated in the seat 28. The bar 32 and pedals 34 may also be removed from the footrest mounts 36 on the inflatable sides 14 to allow the kayak 10 to be folded more easily. As shown in FIGS. 4-5, the kayak 10 may also have footpads 70 to allow the user to stand while paddling.

As shown in FIG. 4, the inflatable floor 12 has a self-bailing drain 40. The self-bailing drain allows any water that is inside the kayak to easily drain through an opening in the floor 12. As shown in FIGS. 4-5, the self-bailing drain 40 may be located in the center of the floor 12, however the drain 40 may be located in any suitable position, such as in the aft of the kayak 10. There may be two drains 40 such as one adjacent the middle of each side 14. However, other suitable locations may be possible. The drain 40 may have a cap to allow the drain to be opened when required The following is a list of reference numbers:

10—inflatable kayak
12—inflatable floor
14—inflatable sides
16—outer fabric layer or panel
18—inflation port
20—bow cap
22—stern cap
24—flexible front hull portion
26—Bottom surface of kayak
28—seat
30—footrests
32—footrest bar
34—footrest pedals
36—footrest mounts
38—skeg
40—self bailing drain
42—fin box
50—drop stitch core
52—flexible outer surface
54—central ridge
56—side panels of hull portion
58—notch
60—skirt panel
62—logos
70—footpads While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An inflatable kayak comprising:
a floor formed of a first drop-stitch inflatable chamber;
a port side formed of a second drop-stitch inflatable chamber;
a starboard side formed of a third drop-stitch inflatable chamber,
a fabric hull panel covering an outboard bottom surface of the floor and at least a portion of an outboard side surface of each of the port and starboard sides, wherein the floor, the port side and the starboard side are attached to the fabric hull panel at spaced apart locations when deflated, wherein the port and starboard sides abut lateral sides of the floor when inflated;
a front hull portion being flexible and attached to the fabric hull panel along a forward portion and forming a bow contour with a sloping ridge, wherein the front hull portion does not extend below the outboard bottom surface of the floor; and
a rigid skeg attached to the fabric hull panel at a rear portion and configured to be removable.

2. The inflatable kayak of claim 1, wherein an air chamber is formed between the fabric hull panel and the front hull portion when the inflatable kayak is inflated.

3. The inflatable kayak of claim 2, wherein the front hull portion has a notched opening to naturally allow airflow to the air chamber as the inflatable kayak is inflated and deflated.

4. An inflatable kayak comprising:
a floor formed of a first drop-stitch inflatable chamber;
a port side formed of a second drop-stitch inflatable chamber;
a starboard side formed of a third drop-stitch inflatable chamber;
a fabric hull panel covering an outboard side of at least a portion of each of the floor, the port side and starboard side; and
at least one flexible hull portion attached to the fabric hull panel forming at least one of a bow contour or stern contour.

5. The inflatable kayak of claim 4, wherein the flexible hull portion is attached to the fabric hull panel along a forward portion to form the bow contour.

6. The inflatable kayak of claim 4, wherein the floor, the port side and the starboard side are attached to the fabric hull panel at spaced apart locations when deflated.

7. The inflatable kayak of claim 4, wherein the port side and the starboard side abut lateral sides of the floor when inflated.

8. The inflatable kayak of claim 4, wherein the port side and the starboard side are configured to extend generally perpendicular to an upper surface of the floor.

9. The inflatable kayak of claim 4, wherein the flexible hull portion is positioned adjacent at least one of a distal bow end or a distal stern end, wherein the floor does not extend to the distal bow end or distal stern end.

10. The inflatable kayak of claim 4, wherein the flexible hull portion is formed of flexible PVC fabric.

11. The inflatable kayak of claim 10, wherein the flexible PVC fabric is glued or welded to the fabric hull panel.

12. The inflatable kayak of claim 4, further comprising a rigid skeg attached to along a rear portion.

13. The inflatable kayak of claim 4, further comprising a pair of footrest pedals, one footrest pedal attached to each of the port and starboard sides.

14. The inflatable kayak of claim 4, wherein each of the footrest pedals has a mount attached to one of the port and starboard sides, and a footrest bar slidable relative to the mount to allow the footrest pedals to be adjusted.

15. The inflatable kayak of claim 4, further comprising at least one self-bailing drain having an opening extending through the floor.

16. The inflatable kayak of claim 4, further comprising at least one seat attached to at least one of the floor and port and starboard sides.

17. The inflatable kayak of claim 4, wherein the floor, the port side and the starboard side are glued or welded to the fabric hull panel.

18. An inflatable kayak comprising:

a floor formed of a first drop-stitch inflatable chamber;

a port side formed of a second drop-stitch inflatable chamber;

a starboard side formed of a third drop-stitch inflatable chamber;

a fabric hull panel connecting the floor, the port side and the starboard side, wherein there is no rigid hull portion to allow the inflatable kayak to be folded to a compact storage position; and a rigid skeg attached to a rear portion and configured to be removable when the inflatable kayak is folded to the compact storage position.

19. The inflatable kayak of claim 18, further comprising at least one flexible hull portion attached to the fabric hull panel forming at least one of a bow contour or stern contour and extending from the fabric hull panel.

20. The inflatable kayak of claim 18, wherein the floor, the port side and the starboard side are attached to the fabric hull panel at spaced apart locations when deflated.

* * * * *